US005270022A

United States Patent [19]

Kothari et al.

[11] Patent Number: 5,270,022

[45] Date of Patent: Dec. 14, 1993

[54] PROCESS FOR THE REDUCTION ROASTING OF MANGANESE ORES AND A DEVICE THEREFOR

[75] Inventors: Sudhakar V. Kothari; Nilkantha A. Subramanian, both of Maharashtra, India

[73] Assignee: Paramount Sinters Private Limited, Maharashtra, India

[21] Appl. No.: 947,799

[22] Filed: Sep. 21, 1992

[51] Int. Cl.[5] ..... C22B 1/02; F27B 9/04

[52] U.S. Cl. ..... 423/49; 266/179

[58] Field of Search ..... 423/49, 605; 75/625; 266/178, 179, 159

[56] References Cited

U.S. PATENT DOCUMENTS 2,750,274 6/1956 Lellep ..... 266/178

4,010,236 3/1977 Welsh ..... 423/49

*Primary Examiner*—Melvyn J. Andrews

*Attorney, Agent, or Firm*—Cushman, Darby & Cushman

[57] ABSTRACT

Reduction roasting of manganese ore is the first step in the extraction of the metal, production of manganese based chemicals and benefaction of ferruginous manganese ores. In comparison to the conventional processes, the invented process replaces the expensive petroleum based reductant injected with air by cheap solid carbonaceous material and sealing of air entry. In the invented process the manganese ore, solid carbonaceous reductant and water are mixed. The mixture is formed into a bed on a grate. The top surface is ignited to incandescence while maintaining suction below the grate and then the top surface is sealed against entry of air while continuing the suction. The combustion of the solid reductant proceeds drawing the oxygen from the ore itself, resulting in high reduction. The product is cooled either by direct water quenching or by indirect means. The equipment employed is either a batch type pot or a continuous strand with sealing devices and material handling systems.

2 Claims, 3 Drawing Sheets

PROCESS FOR THE REDUCTION ROASTING OF MANGANESE ORES AND A DEVICE THEREFOR

This invention relates to a novel process for the reduction roasting of manganese ore and device therefor.

BACKGROUND OF THE INVENTION

Manganese ores form the starting material for the production of manganese based chemicals such as Electrolytic Manganese Dioxide (EMD), Electrolytic Manganese Metal (EMM), Chemical Manganese Dioxide (CMD) or Manganese Sulphate. Low Carbon Ferro Manganese, High Carbon Ferro Manganese and Silico Manganese are some of the Ferro Alloys produced from manganese ores. For the production of manganese based chemicals or ferro alloys such as Low Carbon Ferro Manganese, naturally occurring manganese ores have to be first subjected to reduction roasting to convert the ores from higher oxides into lower oxides. For the production of High Carbon Ferro Manganese, naturally occurring manganese ores can be used directly provided such ores contain manganese and iron atleast in 5:1 ratio. In Ferruginous ores (that is naturally occurring manganese ores with high iron content) the Manganese to Iron ratio is generally less than 5:1 and hence removal of iron therefrom is necessary for further processing. When ferruginous manganese ores are subjected to reduction roasting, the higher iron oxide minerals also get reduced to lower oxide form and are amenable to removal by magnetic seperation thereby improving the manganese to iron ratio. The lower iron manganese ores thus obtained can be used as a starting material for the production of manganese based chemicals or ferro alloys. Lower oxides of manganese produced by reduction roasting are soluble in solvents like sulphuric acid or hydrochloric acid whereas naturally occurring manganese oxide ores are insoluble in such solvents. Therefore, dissolution efficiency of reduction roasted manganese ores is dependent on the degree of reduction. Hence the lower the degree of reduction, higher the wastage of manganese minerals during the production of manganese based chemicals.

PRIOR ART

Conventional process for the reduction roasting of manganese ores comprises grinding manganese ores to-manganese ore fines of size generally upto 0.075 mm., reducing the manganese ore fines generally in a rotary kiln or fluidised bed roaster using a reducing agent at an elevated temperature generally about 1000 degree centigrate and cooling the reduced ore fines out of contact with air. The size of the manganese ore fines obtained by the conventional process of reduction roasting will also be generally upto 0.075 mm. Grinding of manganese ores which are highly abrasive into fines is very expensive. The reducing agent generally used is petroleum based fuel such as oil or gas. Furthermore heating of the fines during reduction, is also done generally using a petroleum based fuel such as oil or gas. Thus considerable petroleum based fuel such as oil or gas which is very expensive is required for the reduction roasting. Besides, during grinding there is a loss of the valuable ore in the form of dust which also creates pollution problems. Burning of petroleum based fuels generates obnoxious fumes which also creates pollution problem. The reducing atmosphere requires to be very carefully controlled by adjusting the fuel to air ratio.

Sophisticated air controls are required to control the air. The reduced fines are prone to reoxidation while being cooled due to inherent large exposed surface area of the fines. In the conventional processes, the conversion of Manganese Dioxide ($MnO_2$) present in the natural ore to Manganous oxide (MnO) phase is generally up to 50% of the raw feed. The conventional processes of reduction roasting are thus expensive, difficult to carry out, less efficient, results in wastage of valuable mineral wealth, require to be very carefully control ,led and create pollution problems.

An object of the present invention is to provide a novel process for reduction roasting of manganese ores which process is comparatively more economical and efficient and is simple and easy to carry out and safe and pollution free.

Another object of the present invention is to provide a novel device for carrying out the novel process for the reduction roasting of manganese ores.

According to the present invention there is provided a novel process for the reduction roasting of manganese ores, said process comprising; mixing manganese ore fines and solid fuel fines with water and forming the resulting mixture into a bed, igniting the top surface of the bed in the presence of air and under suction from below until the top surface thereof becomes incandescent and sealing the bed whose top surface had become incandescent against the entry of air, the heat front formed by ignition liberating inherent or combined oxygen of the manganese ore for combustion of the solid fuel fines and thereby sustaining the flame front formed by ignition to achieve high degree of reduction roasting of the manganese ore, suction being continued to draw the heat front and flame front alongwith the combustion products down through the bed until reduction roasting is over, disintegrating the resulting reduced mass and cooling the same.

The reduction roasted manganese ore obtained by the novel process of the invention can be processed in known manner for the production of manganese based chemicals or ferro alloys.

Combustion products include water vapour, carbon monoxide, carbon dioxide and oxygen.

Manganese ore fines contemplated by the process of the present invention can be fines generally upto −6 mm and include run of mine fines or plant fines.

Solid fuel fines contemplated by the process of the present invention are carbonaceous matter fines such as coke, coal or charcoal fines generally upto −6 mm size. Depending upon the quality of the solid fuel fines and the degree of reduction roasting desired, the percentage of solid fuel fines will vary. The solid fuel fines used may be from 8 to 38% by weight of the manganese ore fines.

Water contemplated by the process of present invention includes water (moisture) present in the manganese ore fines and/or solid fuel fines. Water may be 5–10% by weight of the total of the manganese ore fines and solid fuel fines.

According to the present invention there is also provided a novel device for the reduction roasting of manganese ores, said device comprising a pair of vertically disposed bunkers, each of the said bunkers being open at its upper end and provided with an outlet at its lower end, one of said bunkers being for receiving and discharging manganese ore fines through its open upper end and outlet at its lower end respectively and the other of said bunkers being for receiving and discharging solid fuel fines through its open upper end and outlet at its lower end respectively, the outlet of each of said bunkers being provided with a regulator to regulate the discharge of manganese ore fines and solid fuel fines therethrough respectively; the first endless conveyor horizontally disposed below the outlet of said bunkers and travelling forward in the horizontal plane, said first endless conveyor being so disposed that manganese ore fines and solid fuel fines being discharged through the outlet of said bunkers fall down thereon; a mixer vertically disposed in the proximity of the discharge end of said first endless conveyor, said mixer having an inlet and an outlet, said mixer being so disposed in the proximity of the discharge end of said first endless conveyor that the discharge end of the said first endless conveyor communicates with said inlet of said mixer to trasfer the manganese ore fines and &solid fuel fines on said first endless conveyor into said mixer, said mixer being for mixing said manganese ore fines and solid fuel fines with water and forming a mixture thereof, water being supplied into said mixer through said outlet or inlet of said mixer; a second endless conveyor horizontally disposed at an inclination with respect to the horizontal plane such that its inlet end is below the outlet of said mixer and the mixture of manganese ore fines, solid fuel fines and water falls down thereon, said second endless conveyor travelling forward in the horizontal plane at an inclination with respect to the horizontal plane; a reduction roasting unit the inlet end of which is disposed below the discharge end of said second endless conveyor such that said mixture falls down thereon, said mixture forming into a bed in said reduction roasting unit, said reduction roasting unit comprising means for receiving said mixture and carring said bed and igniting the top surface of said bed until incandescence in the presence of air and sealing the top surface of said bed after ignition until incandescence against entry of air and creating suction from below said bed from the inception of ignition of the top surface of said bed until reduction roasting of said bed is over within the zone in which said top suface of said bed is sealed against entry of air; a disintegrator unit comprising a rotor provided with blades, said rotor with blades being disposed in an air tight casing, said air tight casing being vertically disposed in the proximity of the discharge end of said reduction roasting unit, said air tight casing being provided with an inlet and an outlet, the inlet of said air tight casing communicating with the discharge end of said reduction roasting unit such that the reduction roasted mass enters said disintegrator unit on being discharged; a cooling arrangement disposed below said air tight casing and provided with an inlet and outlet, inlet of said cooling arrangement being connected to said outlet of said air tight casing such that the disintegrated reduction roasted manganese ores from said disintegrator unit fall down into said cooling arrangement; and drive means connected to said first and second endless conveyor, reduction roasting unit and rotor.

DETAILED DESCRIPTION OF THE INVENTION

The following is a detailed description of the present invention with reference to the accompanying drawings in which.

Figure 1:
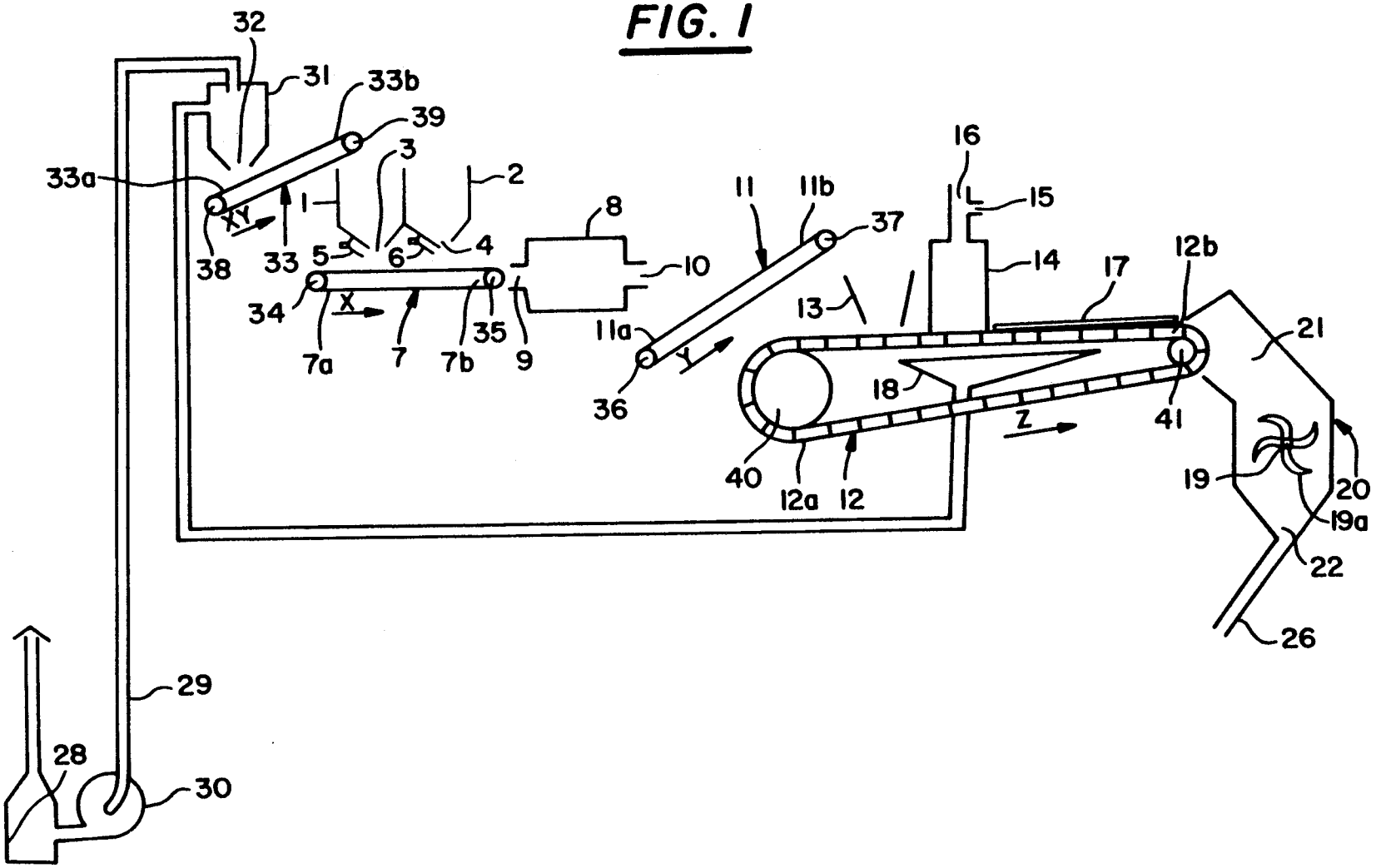
FIG. 1 is schematic view of the device for the reduction roasting of manganes ores according to an embodiment of the present invention without the cooling arrangement.

Refering to FIG. 1 the device is for the reduction roasting of manganese ores in a continuous manner and consists of a pair of vertically disposed bunkers 1 and 2, whose upper ends are open and lower ends are provided with outlets 3 and 4 respectively. Outlets 3 and 4 are provided with regulators 5 and 6 respectively. Bunker 1 receives manganese ore fines (not shown) through its upper open end and discharges the manganese ore fines through outlet 3 at its lower end continuously. Regulator 5 is for regulating the discharge rate of manganese ore fines through outlet 3. Bunker 2 receives solid fuel fines through its open upper end and discharges solid fuel fines through its outlet 4 at its lower end continuously. Regulator 6 is for regulating the discharge rate of solid fuel fines through outlet 4. 7 is a first endless conveyor horizontally disposed below the outlets 3 and 4 of bunkers 1 and 2 respectively. Conveyor 7 is so disposed that manganese ore fines and solid fuel fines being discharged through outlets 3 and 4 of bunkers 1 and 2 fall down thereon. Conveyor 7 travels forward in the horizontal plane in the direction of arrow X towards mixer 8 which is vertically disposed in the proximity of the discharge end **7*b* of conveyor 7. The inlet end of conveyor 7 is marked 7*a*. Mixer 8 is provided with an inlet 9 and outlet 10. Mixer 8 is so disposed in the proximity of the discharge end 7*b* of conveyor 7 that conveyor 7 communicates with inlet 9 of mixer 8 to transfer the manganese ore fines and solid fuel fines on conveyor 7 into mixer 8. Mixer 8 mixes the manganese ore fines and solid fuel fines with water and forms a mixture (not shown) thereof. Water for mixing is supplied into mixer 8 through outlet 10 thereof continously. Water for mixing and can also be supplied through inlet 9 of mixer 8 continously instead of through its outlet 10. 11 is second endless conveyor horizontally disposed at an inclination with respect to the horizontal plane and with its inlet end 11*a* below the outlet 10 of mixer 8 such that the mixture of manganese ore fines and solid fuel fines with water falls down thereon continously. Conveyor 11 travels forward at an inclination with respect to the horizontal plane in the direction of arrow Y. 12 is a series of horizontally disposed pallets, inlet end 12*a* of which is disposed below the discharge end 11*b* of conveyor 11. The pallets 12 travel forward in the horizontal plane in the direction of the arrow Z . 13 is a hopper vertically disposed below the discharge end 11*b* of conveyor 11 and above the inlet end 12*a* of pallets 12 such that said mixture falls down into hopper 13 and from hopper 13 onto pallets 12 and form a bed (not shown) thereon continously. 14 is a fuel fired burner disposed above pallets 12 such that burner 14 ignites the top surface of said bed until incandescence in the presence of air. 15 and 16 are the air inlet and fuel inlet of burner 14 repectively. 17 is air sealing means disposed above pallets 12 to seal said bed whose top suface has been ignited until incandescence by burner 14 against entry of air. 18 is a suction box provided below pallets 12. Suction box 18 is connected to exhaust stack 28 through suction line 29. 30 and 31 are suction fan and dust trap respectively provided in suction line 29. Suction fan 30 creates suction through said bed from the inception of ignition of top surface of said bed until reduction roasting of said bed is over within the zone covered by air sealing means 17, the heat front formed by ignition liberating inherent or combined oxygen of said manganese ore fines within said zone for combustion of said solid fuel fines thereby sustaining the flame front formed by ignition to achieve high degree of reduction roasting of said manganese ore fines, said suction being to draw the combustion products alongwith the heat front and flame front through said bed. 19 is rotor provided with blades 19***a* and disposed in an air tight casing 20. Casing 20 is vertically disposed below the discharge end 12*b* of pallets 12 and is provided with an inlet 21 and outlet 22. Casing 20 is so disposed that the discharge end 12*b* of pallets 12 communicates with inlet 21 of casing 20 and the reduction roasted manganese ore mass from pallets 12 falls down into casing 12 continuously where it is disintegrated by rotor 19 and its blades 19*a* and discharges through outlet 22 into the cooling arrangement of FIG. 3 and FIG. 4 which is described hereinafter. Dust trap 31 is provided with an opening 32 at its lower end. 33 is a third endless conveyor horizontally disposed at an inlcination with respect to the horizontal plane such that its inlet end 33*a* is below dust collector 31 and its discharge end 33*b* is above bunker 1. Conveyor 33 is so disposed that manganese ore dust trapped in trap 31 falls down on conveyor 33 through opening 32 and that from conveyor 33 the manganese ore dust falls down into bunker 1 continuously. Manganese ore dust-free gases are left out through stack 28. The conveyors 7,11 and 33, pallets 12 rotor 19, fan 30 and mixer 8 are driven by prime mover(s) such as electric motor (s), (not shown) by connecting them to the prime mover(s) in known manner using known means such as sprockets, shafts, chains, spur gears or belts (not shown). The sprokets driving conveyors 7, 11 and 33 and pallets 12 are marked 34 and 35, 36 and 37, 38 and 39 and 40 and 41 respectively.

Figure 2:
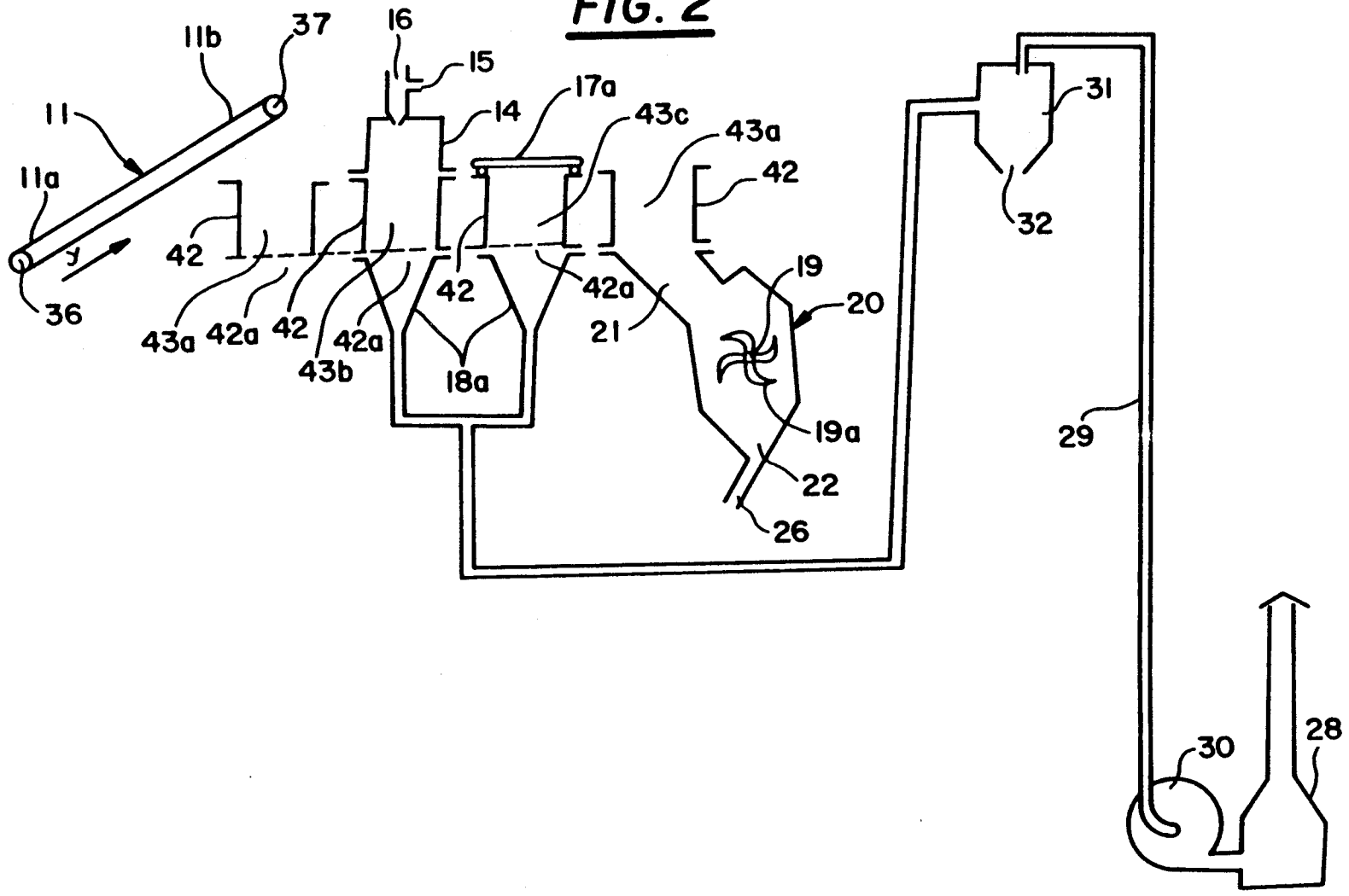
FIG. 2 is schematic view of the device for the reduction roasting of manganese ores according to another embodiment of the present invention without the cooling arrangement.

Referring to FIG. 2 the device is for reduction roasting of manganese ore in a batchwise manner and is similar to the device of FIG. 1 except for the following difference:

42 is a pot with a removable perforated bottom. Pot 42 is vertically disposed and movable in the horizontal plane. Pot 42 can occupy four position viz. filling position (first position), ignition positon (second position), reduction roasting position (third position) and discharge position (fourth position) in sequence as indicated by 43*a*, 43*b*, 43*c* and 43*d*. In the filling position 43*a*, pot 42 comes directly below the discharge end 11*b* of conveyor 11 with its perforated bottom in closed position and said mixture falls down into pot 42 and forms a bed (not shown). After being filled, pot 42 is moved to the ignition position 43*b*. In the ignition position pot 42 comes below burner 14 such that burner 14 ignites the top surface of said bed until incandescence. After ignition the pot is moved to the reduction roasting position 43*c*. In the reduction roasting position, pot 42 is made air tight by air sealing means 17*a* provided at its top. Suction boxes 18 a and 18 a are provided below positions 43*b* and 43*c*. Fan 30 creates suction through said bed from the inception of ignition of the top surface of said bed in position 43*b* and during reduction roasting of said bed in positon 43*c*, the heat front formed by ignition liberating inherent or combined oxygen from said manganese ore fines in pot 42, for combustion of said solid fuel fines in pot 42 thereby sustaining the flame front formed by ignition to achieve a high degree of reduction roasting of said manganese ore fines, suction being to draw the combustion products alongwith the heat front and flame front through said bed. After reduction roasting is completed, pot 42 is moved to the discharge position in which it is connected to inlet 21 of casing 20. In the discharge position which is discharge end of the reduction roasting unit of FIG. 2, the perforated bottom of pot 42 is removed so that the reduction roasted manganese ores mass from pot 42 falls down into casing 20. Pot 42 can be moved manually or automatically. In case pot 42 is moved mechanically, drive to pot 42 is taken from said prime mover(s) in known manner using known means such as those mentioned above.

Figure 3:
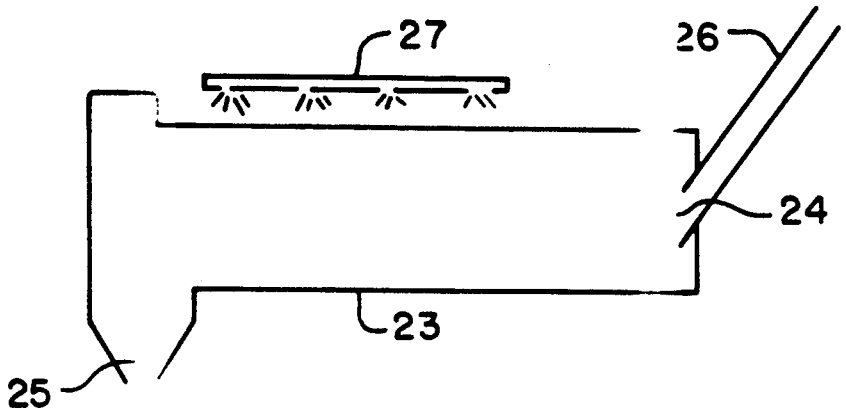
FIG. 3 is schematic view of an indirect type cooling arrangement (indirect rotary drum cooler) for the device of FIG. 1 or FIG. 2.

Referring to FIG. 3 the cooling arrangement is of the indirect cooling type namely indirect rotary drum cooler. The rotary drum 23 is provided with an inlet 24 and outlet 25. The inlet 24 of rotary drum 23 and outlet 22 of casing 20 are interconnected by pipe 26 (see FIGS. 1 and 3 or 2 and 3) so that the disintegrated reduction roasted manganese ores falls down into drum 23 from casing 20. The disintegrated reduction roasted manganese ores are indirectly cooled in drum 23 by spraying water through sprayers or diffusers 27 provided outside the drum 23 so that the cooling water does not come into contact with the disintegrated reduction roasted manganese ores being cooled. Therefore, the cooled ores being discharged through outlet 25 of drum 23 will be dry and can be processed further in knomn manner.

Figure 4:
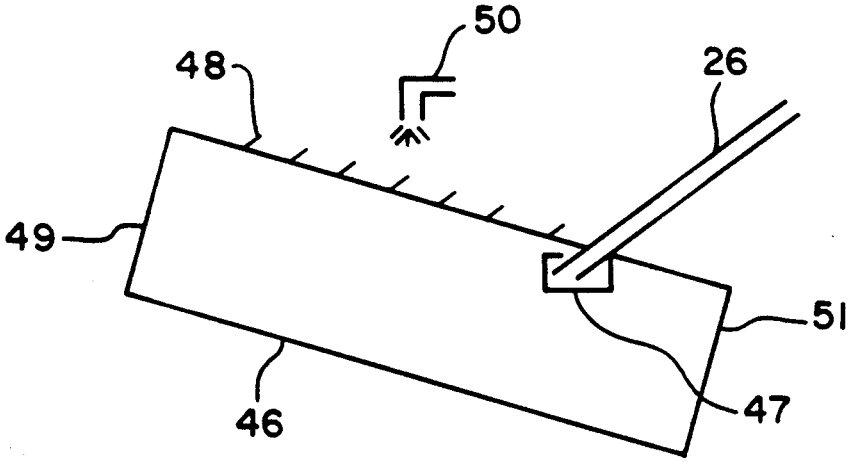
FIG. 4 is schematic view of direct type cooling arrangement (spiral or rake classifier) for the device of FIG. 1 or 2.

Referring to FIG. 4, the cooling arrangement is of the direct cooling type namely spiral or rake classifier. 46 is the quenching tank of the spiral or rake classifier inclined with respect to the horizontal plane and having a pool of water (not shown) at its bottom. 47 is the entry port of tank 46 connected to the inlet 22 of casing 20 by pipe 26 (see FIGS. 1 and 4 or 2 and 4) so that the disintegrated reduction roasted manganese ores fall down into tank 46 from casing 20. In tank 46 rapid cooling of the ores takes place. 48 is the raking mechanism for continously moving the cooled ores upwards to the top discharge opening 49 of tank 46. 50 is the continuous spray of cold water for cooling and washing the disintegrated reduction roasted manganese ores and removing water soluble fraction thereof. Water in tank 46 continuously overflows through exit port 51 thereof and carries with it heat as well as the dissolved fraction. The cooled and washed ores are discharged from opening 49 of tank 46 in a wet condition. The cooled and washed ores are dried in known manner, if necessary, and processed further in known manner.

The size of the manganese ores obtained by the novel process of the present invention is preferably upto 75 mm.

The above embodiments of the device of the present invention are by way of examples and should not be considered to be limitative of the scope of the present invention.

Similarly the following examples are also illustrative of the process of the present invention but not limitative of the scope thereof:

EXAMPLE 1

The following mixture was reduction roasted in a batchwise manner as per the present invention:

| | |
|---|---|
| Mn Ore (−4 mm size) | 68.6 parts by weight |
| Coal (−3 mm size) | 24.3 parts by weight |
| Water | 7.1 parts by weight |
| | 100 parts by weight |

Chemical composition of the Mn Ore prior to reduction roasting was as follows:

| | Assay % by Wt. |
|---|---|
| Mn (total) | 46.8 |
| Fe | 9.4 |
| $MnO_2$ | 67.82 |
| Manganese soluble in 8% dilute sulphuric acid. | Nil. |

Ignition was carried out using liquefied petroleum gas. Ignition time was 1 minute. Reduction roasting time was 15 minutes.

Vaccum applied was 100 mm WG (Water Gauge). Air flow during reduction roasting was nil. Reduction roasted ore was leached with 8% dilute sulphuric acid.$MnO_2$, the form in which manganese is present in the ore prior to reduction is insoluble. The MnO fraction produced by reduction of $MnO_2$ during reduction roasting is soluble. The reduction roasted material produced by conventional and the invented route from the same ore was chemically analysed before acid leaching and the solid residue after leaching was also analysed and by difference Mn (Soluble) was computed for both the routes. The results are as follows.

| Material | Assay % Mn (Total) | Soluble Mn % $\frac{\text{Mn (Sol)}}{\text{Mn (Total)}} \times 100$ |
|---|---|---|
| Reduction roasted product by conventional process | 49.91 | 46.1 |
| Reduction roasted product by novel process | 53.55 | 91.0 |

Note: The difference in Mn (Total) is due to lower product weight as a result of oxygen loss during the reduction roasting. The loss of oxygen is higher in the novel proces during the reduction roasting.

EXAMPLE II

The following mixture was reduction roasted in a batchwise manner as per the present invention.

| | |
|---|---|
| Mn Ore (−4 mm size) | 85.2 parts by weight |
| Coal (−3 mm size) | 7.4 parts by weight |
| Water | 7.4 parts by weight |
| | 100 parts by weight |

Chemical composition of the Mn Ore prior to reduction roasting was as follows:

| | Assay % by weight |
|---|---|
| Mn (total) | 46.0 |
| Fe | 13.24 |

-continued

| | Assay % by weight |
|---|---|
| Mn/Fe | 3.47 |

Ignition was carried out using liquified petroeum gas. Ignition time was 1 minute. Reduction roasting time was 10 minutes. Vaccum applied was 150 mm WG. Air flow during reduction roasting was nil. Reduction roasted ore was subjected to magnetic seperation and the results were as under:

| | | Assay % by Wt. | | Ratio. |
|---|---|---|---|---|
| | Wt. %. | Mn. | Fe. | Mn/Fe. |
| Magnetic fraction | 40.8 | 43 | 23.0 | 1.87 |
| Non-magnetic | 59.2 | 55.1 | 8.6 | 6.45 |
| | 100.0 | | | |

The magnetic fraction can be used as feed in Blast furnaces as it is rich in iron and contains good amount of manganese. The non-magnetic fraction can be directly used for the production of Low Carbon Ferro Manganese or after sintering for the production of high Carbon Ferro Manganese. In the ferro-manganese production Mn:Fe ratio of 6.45 is excellent.

EXAMPLE III

The following mixture was reduction roasted in a batchwise manner as per the present invention.

| | |
|---|---|
| Mn Ore (−4 mm size) | 68.6 parts by weight |
| Coal (−3 mm size) | 24.3 parts by weight |
| Water | 7.1 parts by weight |
| | 100 parts by weight |

Chemical composition of the Mn ore prior to reduction roasting was as follows:

| | Assay % by wt. |
|---|---|
| Mn (total) | 47.2 |
| Fe | 9.0 |
| $K_2O$ | 0.6 |

Ignition was carried out using liquefied petroleum gas. Ignition tune was 1 minute. Reduction roasting time was 15 mintes. Vacuum applied was 100 mm WG. Air flow during reduction roasting was nil. Reduction roasted ore was air cooled and after drawing a sample was quenched in water. After dewatering the solids were analysed for potassium. The sample drawn before quenching was also analysed. By difference in potassium content before and after quenching soluble potassium was computed. Soluble potassium percentage with respect to total potassium content before quenching was caluclated. The results are as under:

$$\frac{K_2O\ (Total)}{\text{Assay \% by WT. 0.65}} \quad \frac{K_2O\ Soluble}{\text{Assay \% by Wt. 0.32}} \quad \frac{\text{Soluble } K_2O \text{ \% by Wt.}}{49} = \frac{K_2O\ Soluble}{K_2O\ Total} \times 100$$

Compared to the conventional process of reduction roasting of manganese ores, the novel process of the present invention has the following advantages:

1. In the novel process no grinding of the manganese ores is required prior to reduction roasting and therefore dust loss resulting from grinding is avoided. The novel process is, therefore, economical and pollution free.

2. In the novel process expensive and scarce petroleum based fuel such as gas or oil is not required either as reducing agent or for heating until reduction roasting is over and in the place of such petroelum based fuel cheap and abundantly available solid fuel fines such as those of coke, coal or charcoal is used, petroleum based fuel being required only to ignite the top surface of the mixture of the manganese ore fines and solid fuel fines with water until incandescence. The novel process, therefore, is economical.

3. Heat required for the reduction roasting as per the novel process is generated within the mixture of manganese ore fines and solid fuel fines with water, whereas heat required for the reduction roasting as per the conventional process is supplied externally. Consequently during the novel process heat utilisation is maximum and heat loss is minimum thereby rendering the novel process more efficient.

4. Since oxygen inherent in the manganese ore fines (that is oxygen in the compound form) is liberated and fully utilised for combustion of solid fuel fines, the novel process achieves almost complete reducing atmosphere thereby achieving a very high decree of reduction roasting, whereas in the conventional process certain amount of air is always employed for combustion and hence the atosphere is only partially reducing.

5. Since no air is employed during reduction roasting as per the novel process no sophisticated air controls are necessary as in the case of the conventional process with the result that the novel process is simple and easy to cary out and economical.

6. Since there is no grinding of manganese ores and since burning of petroleum based fuel is only for a short period that is only upto the stage of igniting the top surface of mixture of manganese ore fines and solid fuel fines with water until incandescence, generation of hazardous dust and emission of obnoxious fumes is eliminated thereby rendering the novel process economical, safe and pollution free.

7. Since the manganese ores used for and obtained after reduction roasting as per the novel process is of coarse size that is generally upto 6 mm, the exposed surface area thereof is comparatively smaller as compaired to exposed surface area of an equal quantity of manganese ores fines of 0.075 mm size used for and obtained by the reduction roasting as per the conventional process. The exposed area of the reduction roasted ores being smaller, reoxidation (which is proportional to exposed surface area) of the ores during cooling as per the novel process is lower.

8. Since certain amount of air is employed during reduction roasting of manganese ores as per the conventional process Nitrogen of the admitted air carries away sensible heat, wheras in the novel process reduction roasting being carried out in an airless condition no loss of sensible heat takes place and therefore the novel process is comparatively more efficient.

9. Potasium, if present, in the manganese ores in water insoluble form, gets converted into water soluble form during reduction roasting by the novel process with the result that potasium which is an undesirable impurity in certain manganese based chemicals such as EMD or CMD can be easily removed by dissolution during cooling of the reduction roasted manganese ores as per the novel process, directly with water.

10. Since the novel process can produce reduced material which can be easily agglomerated by a conventional process of sintering and then can be charged to electric arc smelting furnace directly, considerable saving in electric power during smelting can be achieved in the production of high carbon ferromanganese. The lowering of oxygen level in the reduced material also brings about considerable saving in the consumption of reductants in smelting furnace and makes the furnace operation smoother.

11. In the case of ferruginous manganese ores the novel process has the following additional advantages:

Since a high degree of reduction roasting of manganese ore is achieved as per the novel process, reduction of higher oxides of iron to lower oxides of iron will also be correspondingly high with the result that better magnetic separation of iron minerals from manganese mineral in the reduction roasted ores in possible.

Since the manganese ores used for and obtained by reduction roasting as per the novel process are of coarse size, they are amenable to fusion by sintering, whereas the manganese ores used for and obtained by reduction roasting as per conventional process being microfines of 75 microns can be fused/agglomerated only by the expenssive pelletization method.

Due to high degree of reduction roasting in the novel process loss of oxygen is correspondingly high. Therefore, the manganese content in the reduction roasted manganese ores as per the novel process is high and correspondingly high manganese to iron ratios are achievable.

The manganese ores after being reduction roasted as per the novel process and after being subjected to magnetic separation can be used for the production of ferroalloys such as low carbon ferromanganese. The manganese ore after being reduction rosted as per the novel process and after being subject to magnetic separation can be advantageously used for the production of manganese based chemicals such as EMD or EMM as removal of iron by magnetic separation reduces the load on the chemical process by which iron also had to be removed for the production of such chemicals.

We claim:

1. A novel process for the reduction roasting of manganese ores, said process comprising the steps of:

mixing manganese ore fines and solid fuel fines with water and forming a resulting mixture into a bed having a top surface, the solid fuel fines used being from 8 to 38% by weight of the manganese ore fines wherein water is present in the range of 5 to 10% by weight of the total of the manganese ores fines and solid fuel fines;

igniting the top surface of the bed in the presence of air and under suction from below until the top surface thereof becomes incandescent and sealing the bed whose top surface has become incandescent against entry of air producing a flame front formed by ignition, liberating inherent or combined oxygen of the manganese ore fines which furthers combustion of the solid fuel fines and thereby sustains the flame front formed by ignition to achieve a high degree of reduction roasting of the manganese ore fines, suction being continued to draw the heat front and flame front along with combustion products down through the bed until reduction roasting is over producing a reduced mass comprising reduction roasted manganese ores; and disintegrating the resulting reduced mass and cooling the resulting reduction roasted manganese ores.

2. A novel device for the reduction roasting of manganese ores, said device comprising:

a pair of vertically disposed bunkers, each of the said bunkers being open at its upper end and provided with an outlet at its lower end, one of said bunkers being for receiving and discharging manganese ores fines through its open upper end and outlet at its lower end respectively and the other of said bunkers being for receiving and discharging solid fuel fines through its open upper end and its outlet at its lower end respectively, the outlet of each of said bunkers being provided with a regulator to regulate the discharge of manganese ore fines and solid fuel fines therethrough respectively;

a first endless conveyor horizontally disposed below the outlets of said bunkers and travelling forward in the horizontal plane, said first endless conveyor being so disposed that manganese ore fines and solid fuel fines being discharged through the outlet of said bunkers fall down thereon;

a mixer vertically disposed in the proximity of the discharge end of said first endless conveyor, said mixer having an inlet and outlet, said mixer being so disposed in the proximity of the discharge end of said first endless conveyor that the discharge end of said first endless conveyor communicate with said inlet of said mixer to transfer the manganese ore fines and solid fuel fines on said first endless conveyor into said mixer, sad mixer being for mixing said manganese ore fines and solid fuel fines with water and forming a mixture thereof, water being supplied into said mixer through said outlet or inlet of said mixer;

a second endless conveyor, comprising inlet and discharge ends, horizontally disposed at an inclination with respect to the horizontal plane such that its inlet end is below the outlet of said mixer and the mixture of manganese ore fines, solid fuel fines and water falls down thereon, said second endless conveyor travelling forward in the horizontal plane at an inclination with respect to the horizontal plane;

a reduction roasting unit, comprising inlet and discharge ends, the inlet end of the reduction roasting unit is disposed below the discharge end of the second endless conveyor such that the mixture falls down thereon; said mixture forming into a bed in said reduction roasting unit, said reduction roasting unit comprising:

means for receiving said mixture, means for carrying said bed, means for igniting the top surface of said bed until incandescence in the presence of air, means for sealing the top surface of said bed after ignition against entry of air, and means for creating suction below said bed, within a zone in which the top surface of the bed can be sealed against the entry of air, from the inception of ignition of the top surface of said bed until reduction roasting of said bed is over;

a disintegrator unit comprising a rotor provided with blades, said rotor with blades being disposed in an air tight casing, said air tight casing being vertically disposed in the proximity of the discharge end of said reduction roasting unit, said air tight casing being provided with an inlet and an outlet, the inlet of said air tight casing communicating with the discharge end of said reduction roasting unit such that the reduction roasted mass enters said disintegrator unit on being discharged;

a cooling arrangement disposed below said air tight casing and provided with an inlet and an outlet, the inlet of said cooling arrangement being connected to said outlet of said air tight casing such that the disintegrated reduction roasted manganese ores from said disintegrator unit fall down into said cooling arrangement; and drive means connected to said first and second endless conveyor, reduction roasting unit and rotor.

* * * * *

UNITED STATES PATENT AND TRADEMARK OFFICE

CERTIFICATE OF CORRECTION

PATENT NO. : 5,270,022

DATED : December 14, 1993

INVENTOR(S) : KOTHARI et al.

It is certified that error appears in the above-indentified patent and that said Letters Patent is hereby corrected as shown below:

Title page item [57], col. 2,

Abstract, line 3, change "benefaction" to --beneficiation--.

Column 1, line 52, change "tigrate" to --tigrade--.

Column 3, line 17, delete "&";
line 35, change "carring" to --carrying--;
line 68, change "manganes" to --manganese--.

Column 4, line 45, delete "and";
line 54, delete "of".

Column 6, line 36, change "knomn" to --known--.

Column 9, line 12, change "petroelum" to --petroleum--;
line 34, change "atosphere" to --atmosphere--;
line 52, change "paired" to --pared--;
line 62, change "wheras" to --whereas--;
line 66, change "Potasium" to --Potassium--.

Column 10, line 23, change "in" to --is--;
line 30, change "expenssive" to --expensive--;

UNITED STATES PATENT AND TRADEMARK OFFICE

CERTIFICATE OF CORRECTION

PATENT NO. : 5,270,022

DATED : December 14, 1993

INVENTOR(S) : Kothari et al.

It is certified that error appears in the above-indentified patent and that said Letters Patent is hereby corrected as shown below:

Col. 10, line 42, change "rosted" to --roasted--.

Signed and Sealed this

Twenty-sixth Day of July, 1994

*Attest:*

Bruce Lehman

BRUCE LEHMAN

*Attesting Officer*

*Commissioner of Patents and Trademarks*